US011259683B2

(12) United States Patent
Kopera

(10) Patent No.: US 11,259,683 B2
(45) Date of Patent: Mar. 1, 2022

(54) PUMP ASSEMBLY FOR A DISHWASHER APPLIANCE

(71) Applicant: Haier US Appliance Solutions, Inc., Wilmington, DE (US)

(72) Inventor: Timothy Kopera, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 58 days.

(21) Appl. No.: 16/750,149

(22) Filed: Jan. 23, 2020

(65) Prior Publication Data

US 2021/0228057 A1 Jul. 29, 2021

(51) Int. Cl.

| | |
|---|---|
| ***A47L 15/00*** | (2006.01) |
| ***A47L 15/06*** | (2006.01) |
| ***A47L 15/22*** | (2006.01) |
| ***A47L 15/42*** | (2006.01) |

(52) U.S. Cl.

CPC ..... *A47L 15/4225* (2013.01); *A47L 15/0031* (2013.01); *A47L 15/06* (2013.01); *A47L 15/22* (2013.01)

(58) Field of Classification Search

None

See application file for complete search history.

(56) References Cited

U.S. PATENT DOCUMENTS

| | | | | |
|---|---|---|---|---|
| 3,876,338 | A | 4/1975 | Jarvis, Jr. et al. | |
| 4,004,600 | A | 1/1977 | Corn et al. | |
| 4,754,770 | A | 7/1988 | Fornasari | |
| 5,333,631 | A | 8/1994 | Kirkland et al. | |
| 2012/0291805 | A1* | 11/2012 | Tuller | A47L 15/4225 134/10 |

FOREIGN PATENT DOCUMENTS

| | | | |
|---|---|---|---|
| EP | 1230891 | A1 | 8/2002 |
| WO | WO2018177299 | A1 | 10/2018 |

* cited by examiner

*Primary Examiner* — Levon J Shahinian

(74) *Attorney, Agent, or Firm* — Dority & Manning, P.A.

(57) ABSTRACT

A dishwasher appliance includes a pump assembly for circulating wash fluid within a wash chamber and discharging wash fluid from a drain basin. The pump assembly includes a wash pump impeller coupled to a drive shaft and a drain pump impeller coupled to the drive shaft using a clutch, such as a centrifugal clutch. At speeds below a predetermined speed threshold, the clutch remains disengaged such that only the wash pump impeller rotates. When the speed of the drive shaft exceeds the predetermined speed threshold, the clutch engages causing the drain pump impeller to rotate and discharge wash fluid from the drain basin.

20 Claims, 6 Drawing Sheets

PUMP ASSEMBLY FOR A DISHWASHER APPLIANCE

FIELD OF THE INVENTION

The present disclosure relates generally to dishwasher appliances, and more particularly to improved pump assemblies for dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances use two separate motors to operate a wash pump and a drain pump. However, additional motors take up more space, add cost, and require additional seals, thus increasing the likelihood of leaks and decreasing appliance reliability. Certain dishwasher appliances have eliminated the need for a second motor by using a single motor and a common drive shaft to rotate a wash pump impeller and a drain pump impeller. However, such single motor designs require a bi-directional motor that spins in one direction to circulate wash fluid (i.e., the "wash direction") and the other to drain wash fluid (i.e., the "drain direction"). However, bi-directional motors may frequently be complex and costly.

Accordingly, a dishwasher appliance that utilizes an improved pump assembly would be useful. More specifically, a pump assembly that utilizes a single direction drive motor for operating a wash pump and a drain pump would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a pump assembly for a dishwasher appliance is provided, including a drive shaft, a motor operable to rotate the drive shaft, a wash pump impeller positioned within a pump housing and being coupled to the drive shaft, a drain pump impeller positioned within a drain volute, and a clutch operably coupling the drain pump impeller to the drive shaft, the clutch being movable between a disengaged position when the motor is operating below a predetermined speed threshold and an engaged position when the motor is operating above the predetermined speed threshold.

In a second example embodiment, a dishwasher appliance defining a vertical direction is provided. The dishwasher appliance includes a wash tub that defines a wash chamber, a sump for collecting wash fluid, and a pump assembly positioned within the sump for pumping wash fluid. The pump assembly includes a drive shaft, a motor operable to rotate the drive shaft, a wash pump impeller positioned within a pump housing and being coupled to the drive shaft, a drain pump impeller positioned within a drain volute, and a clutch operably coupling the drain pump impeller to the drive shaft, the clutch being movable between a disengaged position when the motor is operating below a predetermined speed threshold and an engaged position when the motor is operating above the predetermined speed threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
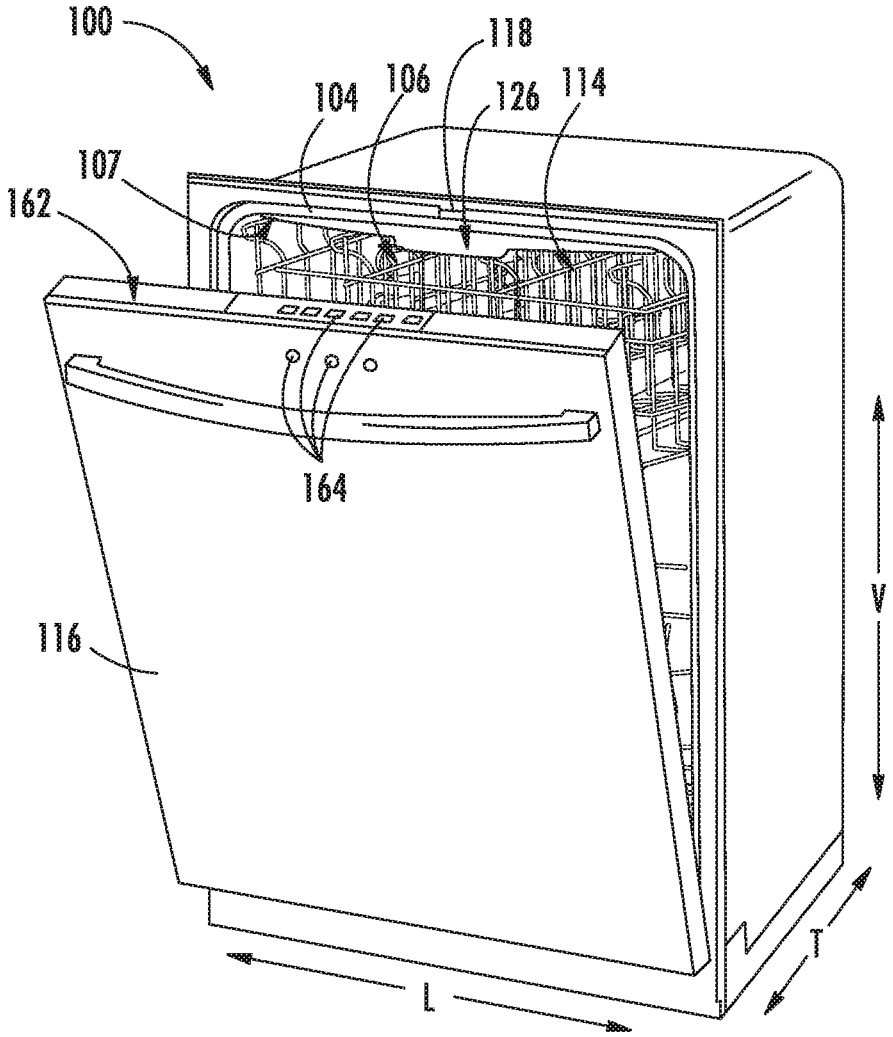
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
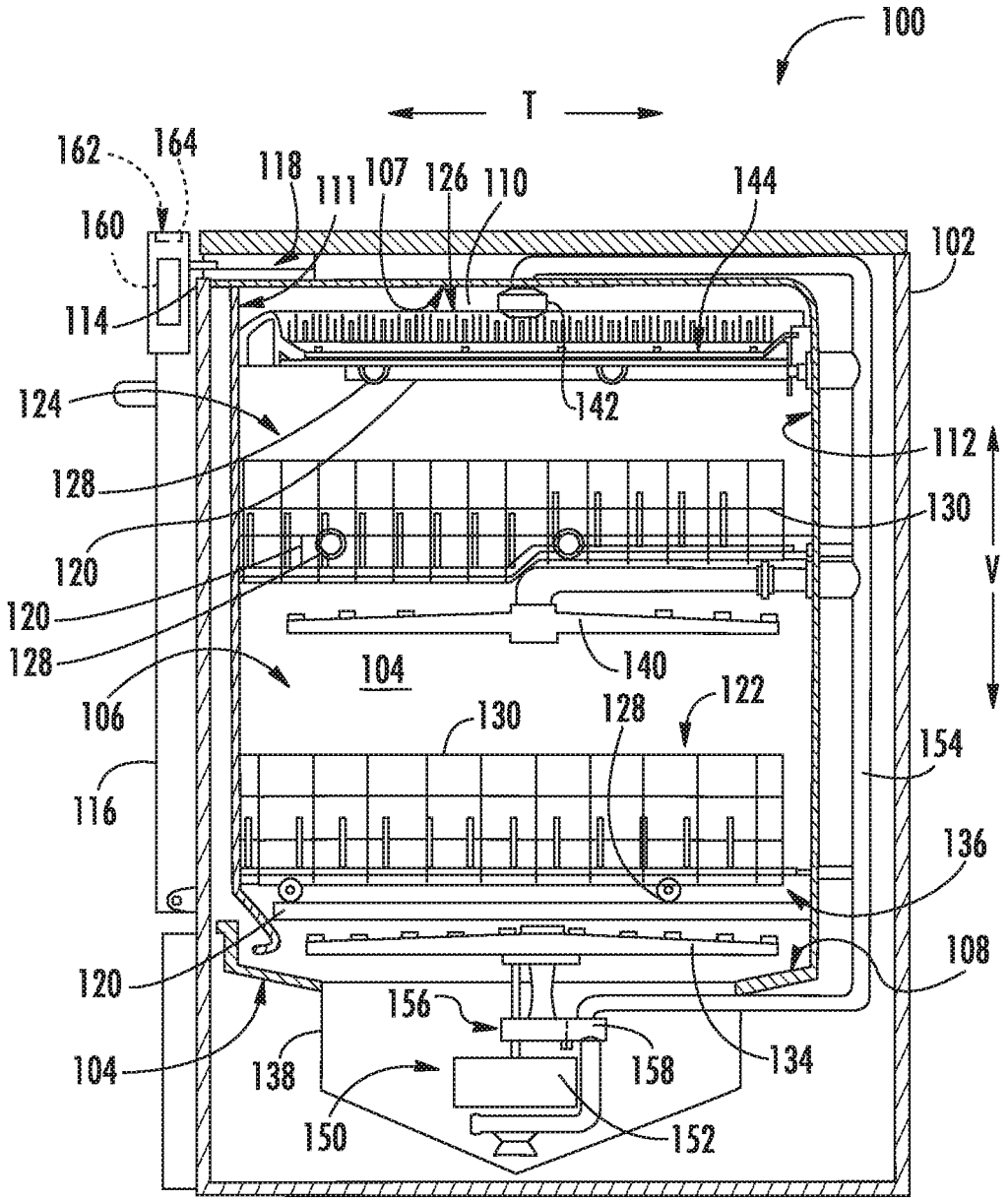
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or pump assembly 150 for circulating water and wash fluid in the tub 104. More specifically, pump assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Pump assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
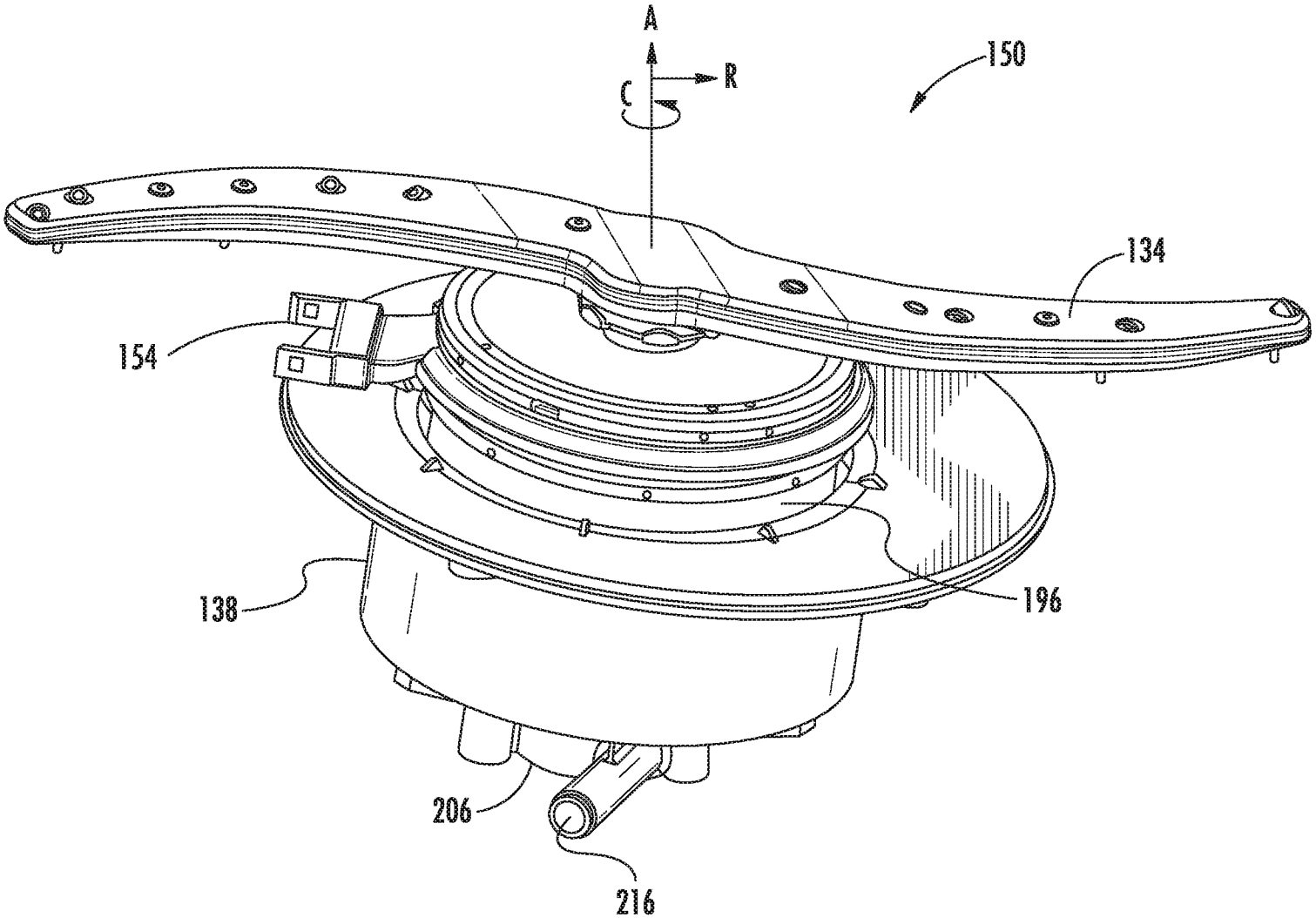
FIG. 3 provides a perspective view of certain components of a pump assembly according to an example embodiment of the present subject matter.
Figure 4:
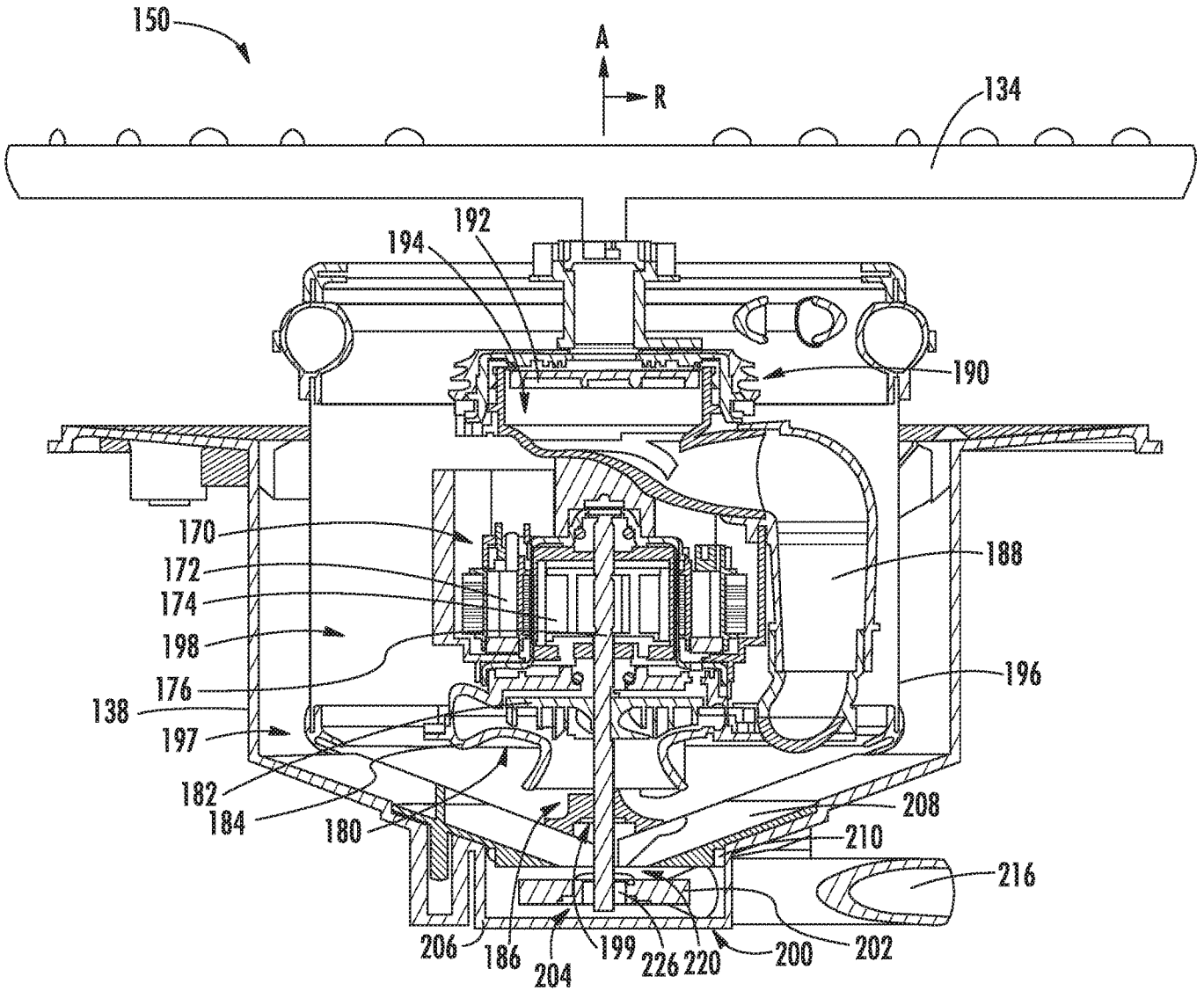
FIG. 4 provides a side, cross sectional view of the exemplary pump assembly of FIG. 3 according to an example embodiment of the present subject matter.

Referring now generally to FIGS. 3 and 4, pump assembly 150 will be described according to an example embodiment of the present subject matter. Pump assembly 150 may include a drive motor 170 that may be disposed within sump 138 of tub 104 and may be configured to rotate multiple components of dishwasher 100. As best shown in FIG. 4, drive motor 170 may be, for example, a brushless DC motor having a stator 172, a rotor 174, and a drive shaft 176 attached to rotor 174. A controller or control board (not shown) may control the speed of motor 170 and rotation of drive shaft 176 by selectively applying electric current to stator 172 to cause rotor 174 and drive shaft 176 to rotate. Although drive motor 170 is illustrated herein as a brushless DC motor, it should be appreciated that any suitable motor may be used while remaining within the scope of the present subject matter. For example, according to alternative embodiments, drive motor 170 may instead be a synchronous permanent magnet motor.

According to an example embodiment, drive motor 170 may be a variable speed motor. In this regard, drive motor 170 may be operated at various speeds depending on the current operating cycle of the dishwasher. For example, according to an exemplary embodiment, drive motor 170 may be configured to operate at any speed between a minimum speed, e.g., 1500 revolutions per minute (RPM), to a maximum rated speed, e.g., 4500 RPM. In this manner, use of a variable speed drive motor 170 enables efficient operation of dishwasher 100 in any operating mode. A variable speed drive motor 170 allows impeller rotation at the desired speeds while minimizing energy usage and unnecessary noise when drive motor 170 does not need to operate at full speed. In addition, according to exemplary embodiments, drive motor 170 may be a single direction motor that rotates only in one direction.

According to an exemplary embodiment, drive motor 170 and all its components may be potted. In this manner, drive motor 170 may be shock-resistant, submersible, and generally more reliable. Notably, because drive motor 170 is mounted inside wash chamber 106 and is completely submersible, no seals are required and the likelihood of leaks is reduced. In addition, because drive motor 170 is mounted in the normally unused space between lower spray arm assembly 134 and a bottom wall of sump 138, instead of beneath the sump 138, this design is inherently more compact than conventional designs.

According to an exemplary embodiment, pump assembly 150 may be vertically mounted within sump 138 of wash chamber 106. More particularly, drive motor 170 of pump assembly 150 may be mounted such that drive shaft 176 is oriented along vertical direction V of dishwasher 100. More particularly, drive shaft 176 may define an axial direction A, a radial direction R, and a circumferential direction C (FIG. 3), with the axial direction A being parallel to the vertical direction V of the dishwasher 100. As illustrated in FIG. 4, drive shaft 176 is rotatably supported by upper and lower bearings and extends out of a bottom of drive motor 170 toward a bottom of sump 138. Although pump assembly 150 is illustrated and described as being vertically mounted, it should be appreciated that aspects of the present subject matter may apply to other pump mounting configurations as well, such as horizontal mount applications.

Referring now to FIG. 4, drive shaft 176 is configured for driving a circulation or wash pump 180. Wash pump 180 may generally be configured for circulating wash fluid within wash chamber 106 during wash and/or rinse cycles. More specifically, wash pump 180 may include a wash pump impeller 182 disposed on drive shaft 176 within a pump housing 184. Pump housing 184 defines a pump intake 186 for drawing wash fluid into wash pump impeller 182. According to the illustrated embodiment, pump intake 186 is facing downward along the vertical direction V and is located very near the bottom of sump 138. In this manner, the amount of water required to prime and operate wash pump 180 is minimized. This is particularly advantageous when running low water cycles for the purpose of water and energy savings.

Referring still to FIG. 4, pump housing 184 is in fluid communication with a supply conduit 188 through which pressurized wash fluid may be recirculated through pump assembly 150. More specifically, according to the illustrated embodiment, wash pump impeller 182 draws wash fluid in from sump 138 and pumps it through supply conduit 188 to a diverter assembly 190 (such as diverter assembly 156) which generally distributes the flow of wash fluid as desired within dishwasher 100.

As shown, diverter assembly 190 may include a diverter disc 192 disposed within a diverter chamber 194 (such as diverter chamber 158). Diverter chamber 194 is fluidly coupled to supply conduit 188, such that rotating diverter disc 192 may selectively distribute the flow of wash fluid to the spray arm assemblies 134, 140, 142, or any other fluid conduit coupled to diverter chamber 194. More particularly, diverter disc 192 may be rotatably mounted about the vertical direction V. Diverter disc 192 may have a plurality of apertures that are configured to align with a one or more outlet ports at the top of diverter chamber 194. In this manner, diverter disc 192 may be selectively rotated to provide wash fluid to spray arm assemblies 134, 140, 142 or other spray assemblies.

As illustrated in FIG. 3, pump assembly 150 further includes a filter screen or filter 196. In general, filter 196 may define an unfiltered region 197 and a filtered region 198 within sump 138. During a wash or rinse cycle, wash fluid sprayed on dishes or other articles within wash chamber 106 falls into the unfiltered region 197. Wash fluid passes through filter 196 which removes food particles, resulting in relatively clean wash fluid within the filtered region 198. As used herein, "food particles" refers to food soil, particles, sediment, or other contaminants in the wash fluid which are not intended to travel through filter 196. Thus, a food particle seal may allow water or other wash fluids to pass from the unfiltered region 197 to the filtered region 198 while preventing food particles entrained within that wash fluid from passing along with the wash fluid.

As illustrated, filter 196 is a cylindrical and conical fine mesh filter constructed from a perforated stainless steel plate. Filter 196 may include a plurality of perforated holes, e.g., approximately 15/1000 of an inch in diameter, such that wash fluid may pass through filter 196, but food particles entrained in the wash fluid do not pass through filter 196. However, according to alternative embodiments, filter 196 may be any structure suitable for filtering food particles from wash fluid passing through filter 196. For example, filter 196 may be constructed from any suitably rigid material, may be formed into any suitable shape, and may include apertures of any suitable size for capturing particulates.

According to the illustrated exemplary embodiment, filter 196 defines an aperture through which drive shaft 176 extends. Wash pump impeller 182 is coupled to drive shaft 176 above filter 196 and a drain pump impeller (e.g., as described below) is coupled to drive shaft 176 below filter 196 along the vertical direction V. Pump assembly 150 may further include an inlet guide assembly 199 which is configured for accurately locating and securing filter 196 while allowing drive shaft 176 to pass through aperture and minimizing leaks between the filtered and unfiltered regions 197, 198 of sump 138. More specifically, as best illustrated in FIG. 4, drive shaft 176 passes through a clearance bore in inlet guide assembly 199 and through filter 196 between unfiltered region 197 and filtered region 198 of sump 138. Because the clearance bore has a diameter that is larger than the diameter of drive shaft 176, inlet guide assembly 199 may further include a washer disposed within a chamber, e.g., in order to accommodate minor drive shaft wobble or misalignment while retaining a particle tight seal.

Referring again to FIG. 4, a drain pump 200 according to an exemplary embodiment of the present subject matter will be described. Drain pump 200 may generally be configured for periodically discharging soiled wash fluid from dishwasher 100. Although illustrated and described as part of pump assembly 150, it should be appreciated that aspects of drain pump 200 may be used in any impeller assembly in any application where it is desirable to selectively pump a fluid. In this regard, drain pump 200 is only one exemplary configuration used for the purpose of explaining aspects of the present subject matter and is not intended to limit the scope of the invention in any manner.

Drain pump 200 may include a drain pump impeller 202 coupled to a bottom portion of drive shaft 176 and positioned within a drain volute 204 below filter 196. More specifically, drain volute 204 is defined by a drain basin 206 of sump 144 and a drain cover 208 that positioned over drain basin 206 and forms a fluid tight seal with drain basin 206, e.g., by using an O-ring 210 or any other suitable sealing mechanism. According to the illustrated embodiment, the bottom of sump 138 and drain cover 208 define a seamless transition and are cone-shaped to help funnel food particles toward drain volute 202. For example, as illustrated, sump 138 and drain cover 208 define a frustum of a cone above drain basin 206.

As best shown in FIG. 4, drain pump 200 further includes a discharge conduit 216 that extends from drain basin 206 and is in fluid communication with drain volute 204. Drain cover 208 defines a drain inlet 220 through which wash fluid may pass into drain volute 204. As illustrated, drain inlet 220 is a circular aperture in the center of drain cover 208, but other sizes and geometries may be used according to alternative embodiments. As illustrated drive shaft 176 passes through drain inlet 220 into drain volute 204 where it is coupled to drain pump impeller 202. During a drain cycle, drain pump impeller 202 draws soiled wash fluid through drain inlet 220 into drain volute 204 and discharges it through discharge conduit 216.

Drain pump volute 202 and discharge conduit 216 are both positioned at the very bottom of sump 138, at the lowest portion of pump assembly 150, providing several operational advantages. Specifically, heavier soil tends to fall toward drain volute 204 where wash fluid and food particles are collected. During a drain cycle, drain pump impeller 202 is rotated and soiled wash fluid is discharged from dishwasher 100 through a discharge conduit 216 such that complete draining of soiled wash fluid may be achieved. After some or all of the soiled wash fluid is discharged, fresh water and/or wash additives may be added and the wash or rinse cycle may be repeated.

Figure 5:
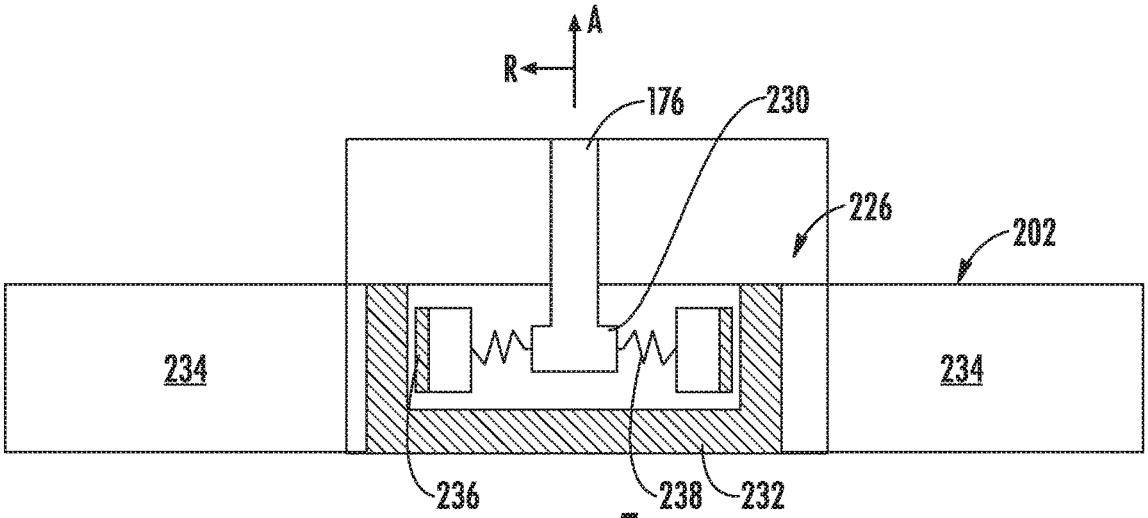
FIG. 5 provides a schematic side view of a clutch assembly that may be used with the exemplary pump assembly of FIG. 3 according to an example embodiment of the present subject matter.
Figure 6:
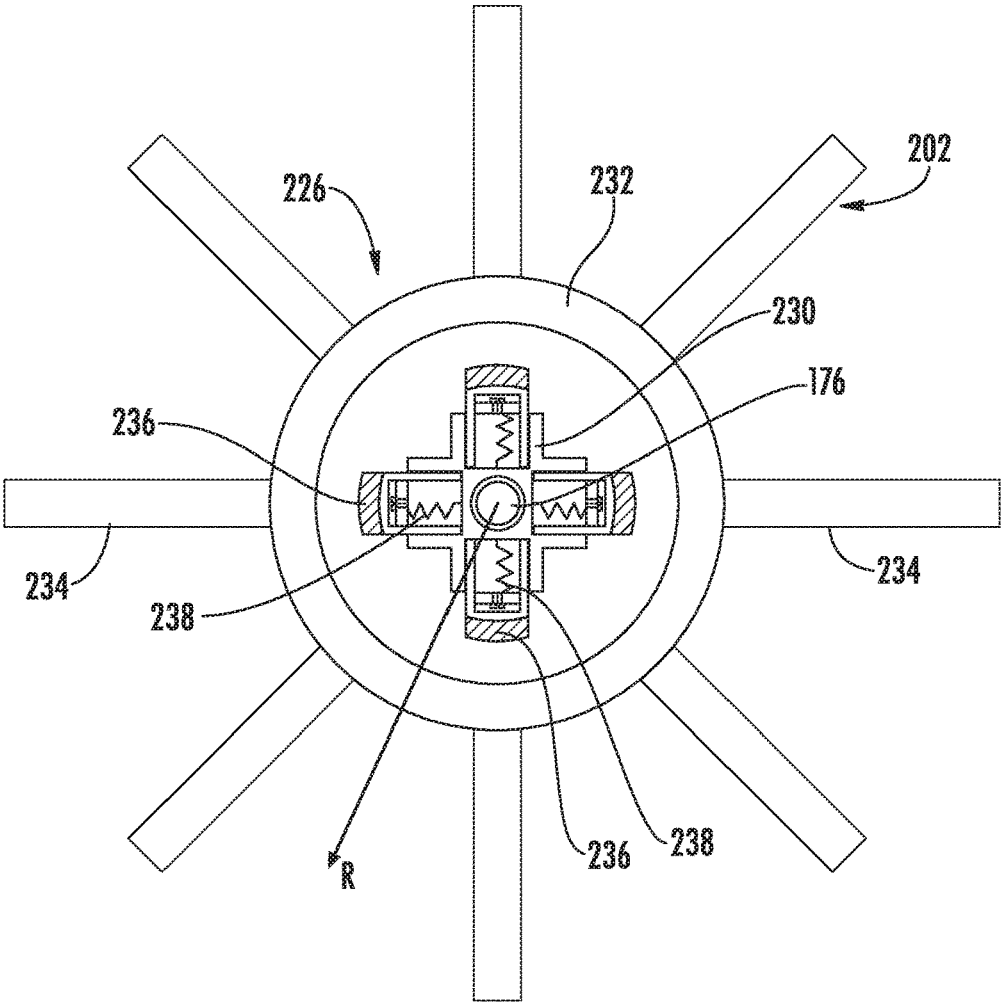
FIG. 6 provides a schematic bottom view of the exemplary clutch assembly of FIG. 4 in a disengaged position.
Figure 7:
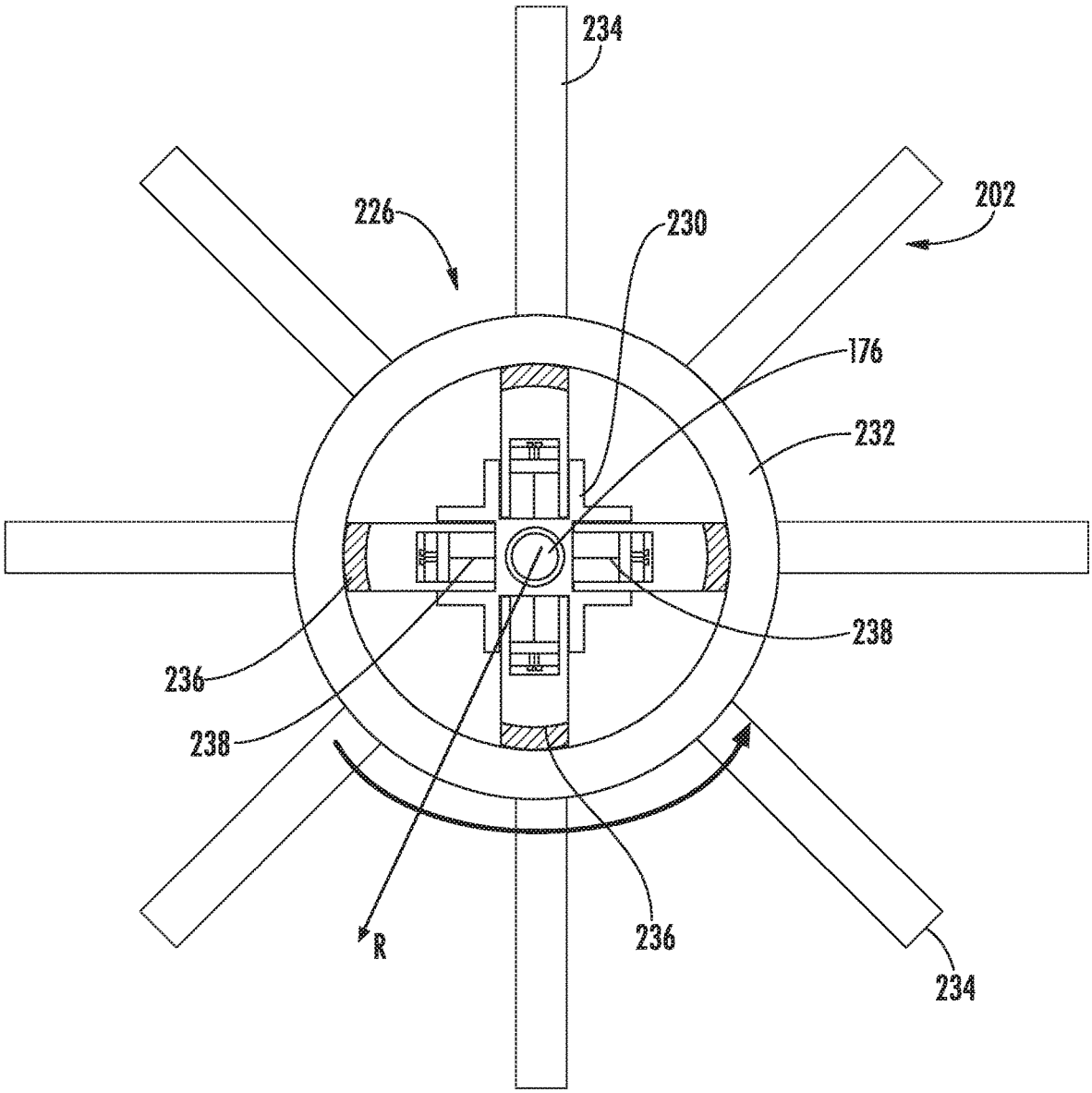
FIG. 7 provides a schematic bottom view of the exemplary clutch assembly of FIG. 4 in an engaged position.

Notably, drain pump impeller 202 is coupled to the bottom portion of drive shaft 176 using a clutch 226. Specifically, referring now to FIGS. 5 through 7, clutch 226 will be described according to an exemplary embodiment of the present subject matter. In this regard, FIGS. 5 and 6 show schematic side and top views, respectively, of clutch 226 in a disengaged position such that drain pump impeller 202 is not rotatably coupled to drive shaft 176. FIG. 7 shows a schematic top view of clutch 226 in an engaged position during a drain cycle.

In general, clutch 226 may be any mechanism designed to disengage drain pump impeller 202 from drive shaft 176 during a wash cycle and engage drain pump impeller 202 with drive shaft 176 during a drain cycle. Specifically, according to an exemplary embodiment, clutch 226 is a centrifugal clutch. In this regard, as shown, clutch 226 includes an inner hub 230 coupled to the drive shaft 176 and an outer drum 232 that is attached to drain pump impeller 202. Specifically, as illustrated, vanes 234 of drain pump impeller 202 may be directly coupled to or formed with outer drum 232 and may extend outward along a radial direction R within drain volute 204. Although outer drum 232 is illustrated as being formed integrally with drain pump impeller 202, it should be appreciated that according to alternative embodiments drain pump impeller 202 may be a separate component that is attached or affixed to outer drum 232.

When clutch 226 is in a disengaged position, inner hub 230 may rotate freely within outer drum 232, such that a drive shaft 176 may rotate wash pump impeller 182 without rotating drain pump impeller 202. By contrast, when clutch 226 is in an engaged position, outer drum 232 is rotationally fixed to inner hub 230 such that they rotate together. A clutch mechanism may be used to facilitate such an engagement and disengagement process. For example, as illustrated, clutch 226 includes a plurality of shoes 236 that are coupled to inner hub 230 and are movable between a disengaged position (FIGS. 5 and 6) where inner hub 230 rotates freely within outer drum 232 and an engaged position (FIG. 7) for locking inner hub 230 and outer drum 232 together such that drive shaft 176 rotates drain pump impeller 202.

Clutch 226 may further include retention springs 238 that operably couple shoes 236 to inner hub 230. In this regard, retention springs 238 urge shoes 236 to slide towards a retracted position along the radial direction R. Thus, at the lower operating speeds of drive motor 170, where the shaft rotation falls below a predetermined speed threshold, shoes 236 remain in the retracted position and do not engage outer drum 232. However, at a higher rotation speeds of drive shaft 176, the centrifugal force on shoes 236 may exceed the spring force exerted by retention springs 238, such that shoes 236 engage and lock onto outer drum 232. In this position, referred to herein as the engaged position, inner hub 230 and outer drum 232 rotate in unison, such that drive shaft 176 drives drain pump impeller 202.

Notably, the design of clutch 226 and the spring constant of retention springs 238 may be used to affect the amount of force or the rotation speeds necessary to place clutch 226 into the engaged position. Therefore, a predetermined speed threshold may be selected where it is desirable that drain pump impeller 202 is engaged and begins rotating. Clutch 226 may be designed such that it moves into the engaged position at or above the predetermined speed threshold. According to an exemplary embodiment, the predetermined speed threshold may be equal to a specific percentage of a rated speed of drive motor 170. For example, the predetermined speed threshold may be 60%, 70%, 80%, 90%, or greater of the rated rotational speed of drive motor 170. For example, according to an exemplary embodiment, the rated speed of drive motor 170 is 4500 RPM and the predetermined speed threshold is 90%, such that clutch 226 is configured for moving into an engaged position when drive motor 170 rotates at 4000 RPM. It should be appreciated that other suitable trip or trigger points of clutch 226 may be used while remaining within the scope of the present subject matter.

Clutch 226 is illustrated schematically above with simple sliding shoes 236 for engaging and disengaging outer drum 232. However, it should be appreciated that other suitable clutch mechanisms may be used while remaining within the scope of the present subject matter. Moreover, it should be appreciated that a secondary clutch may be used to join wash pump impeller 182 to drive shaft. According to such an exemplary embodiment, this secondary clutch may be configured for disengaging wash pump impeller 182 from drive shaft 176 during a drain cycle. Other configurations are possible and within the scope of the present subject matter.

Pump assembly 150 as described above enables both wash pump impeller 182 and drain pump impeller 202 of pump assembly 150 to be placed on a single drive shaft 176. Moreover, a relatively inexpensive single-direction, variable speed drive motor 170 can rotate drive shaft 176 at a first speed for wash/rinse cycles and at a second speed for drain cycles. It should be appreciated that drain pump 200 is used only for the purpose of explaining aspects of the present subject matter. Modifications and variations may be made to pump assembly 150 while remaining within the scope of the present subject matter. For example, the number, size, spacing, and configuration of vanes 234 of drain pump impeller 202 may be adjusted while remaining within the scope of the present subject matter. In addition, the style, operation, and configuration of clutch 226 may vary while remaining within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A pump assembly for a dishwasher appliance, the pump assembly comprising:

a drive shaft;

a motor operable to rotate the drive shaft;

a wash pump impeller positioned within a pump housing and being coupled to the drive shaft;

a drain pump impeller positioned within a drain volute; and a clutch operably coupling the drain pump impeller to the drive shaft, the clutch being movable between a disengaged position when the motor is operating below a predetermined speed threshold and an engaged position when the motor is operating above the predetermined speed threshold, wherein the clutch comprises:

an inner hub coupled to the drive shaft;

an outer drum rotatably coupled to the inner hub, the drain pump impeller being attached to the outer drum assembly; and a plurality of shoes coupled to the inner hub and being movable between a disengaged position where the inner hub rotates freely within the outer drum and an engaged position for locking the inner hub and the outer drum.

2. The pump assembly of claim 1, wherein the motor operates below the predetermined speed threshold during a wash cycle and above the predetermined speed threshold during a drain cycle.

3. The pump assembly of claim 1, wherein the predetermined speed threshold is approximately 90% of a rated speed of the motor.

4. The pump assembly of claim 1, wherein the predetermined speed threshold is approximately 70% of a rated speed of the motor.

5. The pump assembly of claim 1, wherein the predetermined speed threshold is greater than 4000 revolutions per minute.

6. The pump assembly of claim 1, wherein the clutch is a centrifugal clutch.

7. The pump assembly of claim 1, wherein the motor is vertically oriented within a sump area of the dishwasher appliance, such that the drive shaft is vertically oriented relative to the dishwasher appliance.

8. The pump assembly of claim 1, wherein the motor is a variable-speed, single-direction motor.

9. A dishwasher appliance defining a vertical direction, the dishwasher appliance comprising:

a wash tub that defines a wash chamber;

a sump for collecting wash fluid; and a pump assembly positioned within the sump for pumping wash fluid, the pump assembly comprising:

a drive shaft;

a motor operable to rotate the drive shaft;

a wash pump impeller positioned within a pump housing and being coupled to the drive shaft;

a drain pump impeller positioned within a drain volute; and a clutch operably coupling the drain pump impeller to the drive shaft, the clutch being movable between a disengaged position when the motor is operating below a predetermined speed threshold and an engaged position when the motor is operating above the predetermined speed threshold, wherein the clutch comprises:

an inner hub coupled to the drive shaft;

an outer drum rotatably coupled to the inner hub, the drain pump impeller being attached to the outer drum assembly; and a plurality of shoes coupled to the inner hub and being movable between a disengaged position where the inner hub rotates freely within the outer drum and an engaged position for locking the inner hub and the outer drum.

10. The dishwasher appliance of claim 9, wherein the motor operates below the predetermined speed threshold during a wash cycle and above the predetermined speed threshold during a drain cycle.

11. The dishwasher appliance of claim 9, wherein the predetermined speed threshold is approximately 90% of a rated speed of the motor.

12. The dishwasher appliance of claim 9, wherein the predetermined speed threshold is approximately 70% of a rated speed of the motor.

13. The dishwasher appliance of claim 9, wherein the predetermined speed threshold is greater than 4000 revolutions per minute.

14. The dishwasher appliance of claim 9, wherein the clutch is a centrifugal clutch.

15. The dishwasher appliance of claim 9, wherein the motor is vertically oriented within the sump area of the dishwasher appliance, such that the drive shaft is vertically oriented relative to the dishwasher appliance.

16. The dishwasher appliance of claim 9, wherein the motor is a variable-speed, single-direction motor.

17. The dishwasher appliance of claim 9, wherein the drive shaft extends out of the bottom side of the motor, the dishwasher appliance further comprising:

a filter defining an aperture and a bottom portion of the drive shaft extends through the aperture, wherein the wash pump impeller is coupled to the bottom portion of the drive shaft above the filter along the vertical direction and the drain pump impeller coupled to the bottom portion of the drive shaft below the filter along the vertical direction.

18. The dishwasher appliance of claim 9, further comprising:

a drain basin positioned proximate a bottom of the sump of the dishwasher appliance;

a drain cover positioned over the drain basin to define a drain volute, the drain cover defining a drain inlet to the drain volute; and a discharge conduit in fluid communication with the drain volute, wherein the drain pump impeller is configured for discharging wash fluid when the motor rotates faster than the predetermined speed threshold.

19. A dishwasher appliance defining a vertical direction, the dishwasher appliance comprising:

a wash tub that defines a wash chamber;

a sump for collecting wash fluid;

a drain basin positioned proximate a bottom of the sump;

a drain cover positioned over the drain basin to define a drain volute, the drain cover defining a drain inlet to the drain volute;

a discharge conduit in fluid communication with the drain volute; and a pump assembly positioned within the sump for pumping wash fluid, the pump assembly comprising:

a drive shaft;

a motor operable to rotate the drive shaft;

a wash pump impeller positioned within a pump housing and being coupled to the drive shaft;

a drain pump impeller positioned within the drain volute; and a clutch operably coupling the drain pump impeller to the drive shaft, the clutch being movable between a disengaged position when the motor is operating below a predetermined speed threshold and an engaged position when the motor is operating above the predetermined speed threshold.

20. The dishwasher appliance of claim 19, wherein the clutch comprises:

an inner hub coupled to the drive shaft;

an outer drum rotatably coupled to the inner hub, the drain pump impeller being attached to the outer drum assembly; and a plurality of shoes coupled to the inner hub and being movable between a disengaged position where the inner hub rotates freely within the outer drum and an engaged position for locking the inner hub and the outer drum.

* * * * *